United States Patent [19]

Swiecicki

[11] 4,280,840

[45] Jul. 28, 1981

[54] METHOD OF PROCESSING SPONGE IRON

[75] Inventor: Z. Alexander Swiecicki, Pittsburgh, Pa.

[73] Assignee: Pullman Incorporated, Chicago, Ill.

[21] Appl. No.: 92,610

[22] Filed: Nov. 8, 1979

[51] Int. Cl.[3] ..... C21B 13/00

[52] U.S. Cl. ..... 75/43; 75/38; 75/256; 428/576

[58] Field of Search ..... 428/576; 75/40, 44 R, 75/43, 256, 0.5 BA, 38

[56] References Cited

U.S. PATENT DOCUMENTS

| | | | |
|---|---|---|---|
| 1,869,925 | 8/1932 | Turnbull | 75/44 R |
| 2,035,838 | 3/1936 | Reeder et al. | 294/73 |
| 2,063,402 | 12/1936 | Rossman | 266/160 |
| 3,147,106 | 9/1964 | Johnson et al. | 75/0.5 BA |
| 3,149,734 | 9/1964 | Ilmoni | 214/18 R |
| 3,271,089 | 9/1966 | Krellen | 312/31.2 |
| 3,688,925 | 9/1972 | Oldberg | 214/18 R |
| 4,188,022 | 2/1980 | Beggs et al. | 266/195 |

FOREIGN PATENT DOCUMENTS

| | | | |
|---|---|---|---|
| 891802 | 3/1962 | United Kingdom | 75/0.5 BA |

*Primary Examiner*—M. J. Andrews

*Attorney, Agent, or Firm*—Paul A. Kerstein

[57] ABSTRACT

Sponge iron produced at a direct reduction plant is placed into containers and transported to a smelting furnace whereupon the container and contents are dumped into the furnace for charging the same.

13 Claims, 3 Drawing Figures

METHOD OF PROCESSING SPONGE IRON

BACKGROUND OF THE INVENTION

1. Field of Invention

The invention relates to a steel-making process. More specifically, the invention relates to sponge iron resulting from a direct reduction process and its packing, transportation and charging of a smelter vessel with the same.

2. Description of the Prior Art

Patents of the prior art which pertain to charging of furnaces or handling materials in containers are U.S. Pat. No. 2,035,838, Mar. 31, 1936 and 3,271,089, Sept. 6, 1966. These disclose containers similar to the one utilized in the present invention. However; in these patents, there is no suggestion as to the ultimate disposition of the container as indicated in the present invention wherein the container forms a part of the charge in the smelter.

U.S. Pat. No. 2,063,402, Dec. 8, 1966 discloses a charging of an open hearth furnace. However; unlike the present invention, there is no utilization of the charging bucket as part of the furnace charge.

U.S. Pat. No. 3,149,734, Sept. 22, 1964 and 3,688,925, Sept. 5, 1972 disclose charging apparatus. However; neither of these disclose the concept of utilizing a vacuum sealed iron container as a part of the sponge iron charge in the process of steel making.

SUMMARY OF THE INVENTION

The invention is concerned with the processing of sponge iron after it leaves the reduction furnace of a reduction plant. The sponge iron is placed into containers which are constructed of iron plates. The containers include openings which are sealed after the container has been welded shut. The filled container is first subjected to vacuum producing means and then an inert substance is introduced. After sealing said openings the container is ready for shipment to a smelting plant. During the charging of the steel-making smelter, the entire container, contents and all, are dumped into the vessel, the iron constitutuancy of the container thus adding material which is compatible to the charge.

DESCRIPTION OF THE PREFERRED EMBODIMENT

The J. Celada, et al U.S. Pat. No. 3,467,368, patented Sept. 16, 1969, discloses an Ore Treating apparatus which is utilized for the direct gaseous reduction of iron ore to what is known in the art as sponge iron. The gaseous reduction process is also well described in the Celada U.S. Pat. No. 2,900,247.

It is well known that sponge iron has certain reactions which make it particularly difficult to transport as well as store. Sponge iron has a very high specific surface; it is very porous because oxygen has been removed during reduction and reactivity of the directly reduced iron is high. Therefore, when brought into contact with the air, it has a tendency to pick up oxygen and reoxidizes very quickly. Outdoor storage is not the best solution. During transportation on water or by other means, care must be taken to prevent against oxidation.

Figure 1:
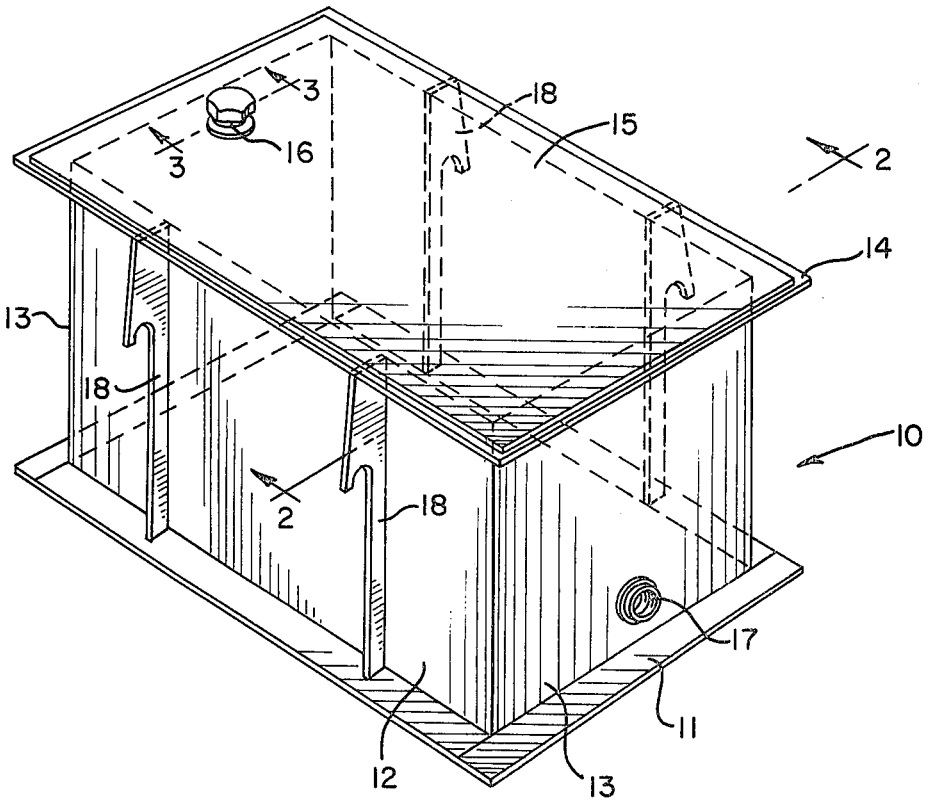
FIG. 1 is a perspective view of a container utilized for transporting and charging sponge iron.
Figure 2:
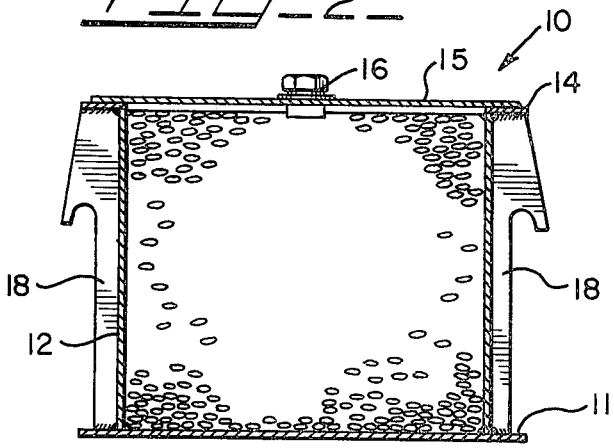
FIG. 2 is a cross-sectional view taken particularly along the line 2—2 of FIG. 1.
Figure 3:
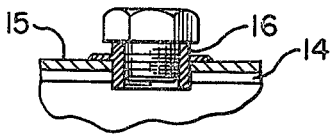
FIG. 3 is a cross sectional view taken along line 3—3 of FIG. 1.

Referring to FIGS. 1 and 2, a container 10 comprises a base plate 11, side walls 12, and end walls 13. An upper flange 14 projecting outwardly is coextensive with the upper edges of the side walls 12 and end walls 13. A top plate 15 is welded over the flange 14 when the sponge iron has filled the container 10. An air outlet 16 is provided on the plate 15 and another similar threaded outlet 17 is provided on one of the end walls 13. Suitable hoisting lugs 18 are secured to and project outwardly from the side walls 12.

THE PROCESS

The container with its top cover plate 15 removed is filled with sponge iron after the reduction process.

Upon filling the cover plate 15, it is welded closed over the flange 14.

The opening 16 then is placed into communication with a source of minus pressure (vacuum pump, etc.) and the interior thereof is then filled with a source of inert gas or other substance through the opening 17. Such substance could be inert gas and/or ammonia which would render the product impervious to other external influences. Thus the aforementioned problems of sponge iron are avoided.

The filled containers are then transported to the smelter site by any conventional transportation means. By virtue of the lifting lugs on the containers, they can readily be loaded onto barges, ships, trucks, railway cars, etc. and can suitably be stacked on top of one another.

Each container will contain a sufficient predetermined quantity of product so that a measured amount will be placed in a charging furnace.

CONTAINER FILLING

The container comprises metal plates welded together, the plates consisting of hot rolled steel 11 gauge, though, of course, other steel may be utilized. The capacity of the container is selected on the basis of ease of handling and also on the smelter or prevailing arc furnace charge bucket size which averages 25 to 30 tons.

During loading of the container, a rotary loading chute at a bin is activated and the container which is moving on a container car is filled. As the container car advances to the next position, the top lid is automatically lifted and placed in proper position on the container. The lid is then sealed by means of welding machines which weld the edges of the lid 15, onto the flange 14.

A source of vacuum may then be applied to either of the openings 16 and 17, and then a source of inert substance is introduced through the other opening for injecting the same to insure the total preservation of the sponge iron within the container. After this, the openings are closed by pipe plugs (not shown) and the container is ready for transportation.

The analysis of the composition, etc., of the container is known and may be so marked on the container so that the container is ready for charging when it reaches the smelter site. When the furnaces or smelters are charged, the entire container is dumped into the furnace and since it is of compatible metal, it will add to the furnace charge.

The process will render the product resistant to oxidation, will minimize abrasion and pulverization of the product.

It will not be subject to air pollution nor will it pollute the air during its handling. It will be secure from spillage or waste and be delivered to the ultimate user in its intended quantity and quality.

Thus, it is believed an improved and novel sponge iron container and process has been set forth and described.

What is claimed is:

1. A method of processing sponge iron from a direct reduction plant comprising the steps of;

filling a container with sponge iron, sealing said container and applying a minus atmosphere pressure source thereon to vacuum seal the same, introducing into said container a means to suppress any chemical reactions within said container, transporting said container to a smelting furnace and charging said furnace with said container and the contents therein.

2. The invention in accordance with claim 1, said container consisting of a material similar to the sponge iron contained therein.

3. The invention in accordance with claim 1, said container consisting of iron material.

4. The invention in accordance with claim 1, said means comprising an inert substance.

5. The invention in accordance with claim 4, said inert substance comprising a gas.

6. The invention in accordance with claim 5, said inert substance, including ammonia.

7. The invention in accordance with claim 1, said container being suitable for stacking and including hoisting means.

8. A method of processing sponge iron from a direct reduction plant comprising the steps of;

filling a container with sponge iron at a direct reduction plant, sealing said container, applying a minus atmosphere pressure source thereon to vacuum seal the container, transporting said container to a smelting furnace, and charge said furnace with said sealed container and sponge iron contained therein.

9. The invention in accordance with claim 8, said container being constructed with iron materials compatible with sponge iron during the smelting process.

10. The invention in accordance with claim 9, said container being suitable for stacking and including hoisting means.

11. The invention in accordance with claim 8, wherein said means to suppress comprises applying a minus atmospheric pressure source to said container.

12. The invention in accordance with claim 8, wherein said means to suppress comprise applying an inert gas source to said container.

13. A method of processing sponge iron from a direct reduction plant comprising the steps of;

filling a container with sponge iron, introducing into said container a means to suppress any chemical reactions within said container, and transporting said container to a smelting furnace and charging said furnace with said container and the contents therein.

* * * * *